US009424828B2

(12) United States Patent
Warkentin et al.

(10) Patent No.: US 9,424,828 B2
(45) Date of Patent: Aug. 23, 2016

(54) SYSTEM AND METHOD OF MICROPHONE PLACEMENT FOR NOISE ATTENUATION

(71) Applicant: Bose Corporation, Framingham, MA (US)

(72) Inventors: David Warkentin, Boston, MA (US); Ryan Struzik, Hopkinton, MA (US); Wade Torres, Attleboro, MA (US); Paul T. Bender, Framingham, MA (US); David Easterbrook, Shrewsbury, MA (US)

(73) Assignee: Bose Corporation, Framingham, MA (US)

( * ) Notice: Subject to any disclaimer, the term of this patent is extended or adjusted under 35 U.S.C. 154(b) by 112 days.

(21) Appl. No.: 14/449,325

(22) Filed: Aug. 1, 2014

(65) Prior Publication Data

US 2016/0035341 A1 Feb. 4, 2016

(51) Int. Cl.

| | |
|---|---|
| ***G10K 11/16*** | (2006.01) |
| ***G10K 11/178*** | (2006.01) |
| ***H04R 1/10*** | (2006.01) |

(52) U.S. Cl.

CPC ..... *G10K 11/178* (2013.01); *G10K 11/1784* (2013.01); *H04R 1/1083* (2013.01); *G10K 2210/1282* (2013.01); *G10K 2210/3055* (2013.01); *G10K 2210/3226* (2013.01); *H04R 2227/001* (2013.01); *H04R 2410/01* (2013.01); *H04R 2499/13* (2013.01)

(58) Field of Classification Search

CPC ..... G10K 2210/128; G10K 2210/1281; G10K 2210/12182; G10K 2210/3055

USPC ..... 381/66, 83, 93, 71.1–71.8, 71.11–71.12

See application file for complete search history.

(56) References Cited

U.S. PATENT DOCUMENTS

| | | | | |
|---|---|---|---|---|
| 7,313,241 | B2 * | 12/2007 | Hamacher | H04R 25/70 381/312 |
| 8,160,264 | B2 * | 4/2012 | Itou | G10K 11/178 381/71.12 |
| 8,340,312 | B2 | 12/2012 | Johnson et al. | |
| 8,903,101 | B2 * | 12/2014 | Christoph | G10K 11/1784 379/406.01 |
| 9,305,541 | B2 * | 4/2016 | Caillet | G10K 11/1784 |
| 2003/0112980 | A1 | 6/2003 | Vaishya | |
| 2005/0031143 | A1 * | 2/2005 | Devantier et al. | 381/300 |
| 2006/0188107 | A1 | 8/2006 | Inoue et al. | |
| 2006/0274901 | A1 * | 12/2006 | Terai et al. | 381/17 |

(Continued)

OTHER PUBLICATIONS

International Search Report and Written Opinion in counterpart PCT Application No. PCT/US15/43105, mailed on Nov. 26, 2015; 10 pages.

*Primary Examiner* — Disler Paul

(74) *Attorney, Agent, or Firm* — Schmeiser, Olsen & Watts LLP

(57) ABSTRACT

A method and system for attenuating noise comprises identifying a location in an area at which sound emitted from one or more speakers has acoustic characteristics that are substantially similar in measure to corresponding acoustic characteristics of the emitted sound at a location approximated to be near an ear of an occupant of the area. A microphone, which may be a virtual microphone, is disposed at the identified location. The microphone detects sound at the identified location. In response to the sound detected by the microphone, the one or more speakers emit a noise-canceling audio signal adapted to attenuate one or more frequencies in the sound detected by the microphone.

12 Claims, 4 Drawing Sheets

(56) References Cited

U.S. PATENT DOCUMENTS

| | | | | |
|---|---|---|---|---|
| 2008/0137874 | A1 | 6/2008 | Christoph | |
| 2010/0027805 | A1 | 2/2010 | Itou et al. | |
| 2010/0266135 | A1 | 10/2010 | Theobald et al. | |
| 2011/0142248 | A1 | 6/2011 | Sakamoto et al. | |
| 2012/0033821 | A1 | 2/2012 | Ohta et al. | |
| 2012/0300952 | A1* | 11/2012 | Burnett | 381/59 |
| 2013/0259250 | A1 | 10/2013 | Nicholson et al. | |
| 2013/0311040 | A1 | 11/2013 | Hasegawa et al. | |
| 2015/0365771 | A1* | 12/2015 | Tehrani | 381/71.6 |

* cited by examiner

SYSTEM AND METHOD OF MICROPHONE PLACEMENT FOR NOISE ATTENUATION

BACKGROUND

This specification relates generally to noise cancellation systems, and, more specifically, to noise attenuation or cancellation (referred to generally as noise cancellation) within a specific environment, such as a passenger compartment of a vehicle.

SUMMARY

All examples and features mentioned below can be combined in any technically possible way.

In one aspect, a method for attenuating noise is provided. The method comprises identifying a location in an area at which sound emitted from one or more speakers has acoustic characteristics that are substantially similar in measure to corresponding acoustic characteristics of the emitted sound at a location near an ear of an occupant of the area. A microphone is placed at the identified location. In response to sound detected by the microphone, a noise-canceling audio signal is generated to attenuate one or more frequencies in the sound detected by the microphone.

Embodiments of the method may include one of the following features, or any combination thereof.

The microphone of the method can be a virtual microphone comprised of multiple microphones placed in the area. The area can be a passenger compartment of a vehicle Signals produced by the multiple microphones can be combined to produce a composite response with acoustic characteristics substantially similar in measure to the acoustic characteristics of the emitted sound at the location near an ear of the occupant of the environment. Additionally, the acoustic characteristics of the sound emitted by the one or more speakers include phase and magnitude.

Further, the identifying of a location at which sound emitted from one or more speakers has acoustic characteristics that are substantially similar in measure to corresponding acoustic characteristics of the sound at a location approximated to be near an ear of an occupant in the area can comprise: computing a first transfer function for the sound emitted from the one or more speakers at the location near the ear of an occupant of the area; computing a second transfer function for the sound emitted from the one or more speakers at a second location in the area spatially separated from the location near the ear; comparing the first transfer function to the second transfer function; and identifying the second location as a candidate for the identified location at which to place the microphone if the second transfer function is substantially similar in measure to the first transfer function.

The method can further comprise determining the second transfer function is substantially similar in measure to the first transfer function if a phase component of the second transfer function is within 35 degrees of a phase component of the first transfer function, and if a magnitude component of the second transfer function is within −8.5 dB or +4.5 dB of a magnitude component of the first transfer function.

In another aspect, a noise-cancellation system comprises one or more speakers, disposed within an environment, emitting sound, and a microphone disposed within the environment at a location where the sound emitted by the one or more speakers has a transfer function from the one or more speakers to the microphone that is substantially similar in measure to a transfer function of the sound emitted from the one or more speakers to a location at an ear of an occupant of the environment.

Embodiments of the system may include one of the following features, or any combination thereof.

The microphone may be a virtual microphone comprised of multiple microphones placed within the environment. A controller may receive the signals produced by the multiple microphones, and combine these signals to produce a composite signal with acoustic characteristics substantially equivalent to the acoustic characteristics of the emitted sound at the location near an ear of an occupant of the environment. Also, each transfer function may have a magnitude component and a phase component.

Further, the microphone may produce a signal in response to detecting sound, and the noise-cancellation may further comprise a controller receiving the signal produced by the microphone and, in response to this signal, generating an output signal. In response to the output signal, the one or more speakers may emit a noise-canceling audio signal designed to attenuate one or more frequencies in the sound detected by the microphone.

In addition, the transfer functions may be substantially similar in measure to each other if a phase component of one of the transfer functions is within 35 degrees of a phase component of the other of the transfer functions, and if a magnitude component of one of the transfer functions is within −8.5 dB or +4.5 dB of a magnitude component of the other of the transfer functions.

The noise-cancellation system may further comprise an amplifier receiving and amplifying the output signal produced by the controller and sending the amplified output signal to the one or more speakers for emission.

In another aspect, a vehicle comprises a passenger compartment and a noise cancellation system comprising one or more speakers disposed within the passenger compartment. The one or more speakers emit sound. The noise cancellation system further comprises a microphone disposed within the passenger compartment at a location where the sound emitted by the one or more speakers has a transfer function from the one or more speakers to the microphone that is substantially similar in measure to a transfer function of the sound emitted from the one or more speakers to a location at an ear of an occupant of the passenger compartment.

Embodiments of the system may include one of the following features, or any combination thereof.

The microphone of the noise cancellation system can be a virtual microphone comprised of multiple microphones placed within the environment.

A controller may receive the signals produced by the multiple microphones and combine these signals to produce a composite signal with acoustic characteristics substantially equivalent to the acoustic characteristics of the emitted sound at the location near an ear of an occupant of the environment.

The microphone may produce a signal in response to detecting sound; a controller may receive the signal produced by the microphone and, in response to this signal, generate an output signal. In response to the output signal, the one or more speakers may emit a noise-canceling audio signal adapted to attenuate one or more frequencies in the sound detected by the microphone.

In addition, each transfer function may have a magnitude component and a phase component. Further, the transfer functions are substantially similar in measure to each other if a phase component of one of the transfer functions is within 35 degrees of a phase component of the other of the transfer functions, and if a magnitude component of one of the transfer functions is within −8.5 dB or +4.5 dB of a magnitude component of the other of the transfer functions. An amplifier may receive and amplify the output signal produced by the controller and send the amplified output signal to the one or more speakers for emission.

BRIEF DESCRIPTION OF THE DRAWINGS

The above and further features and advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
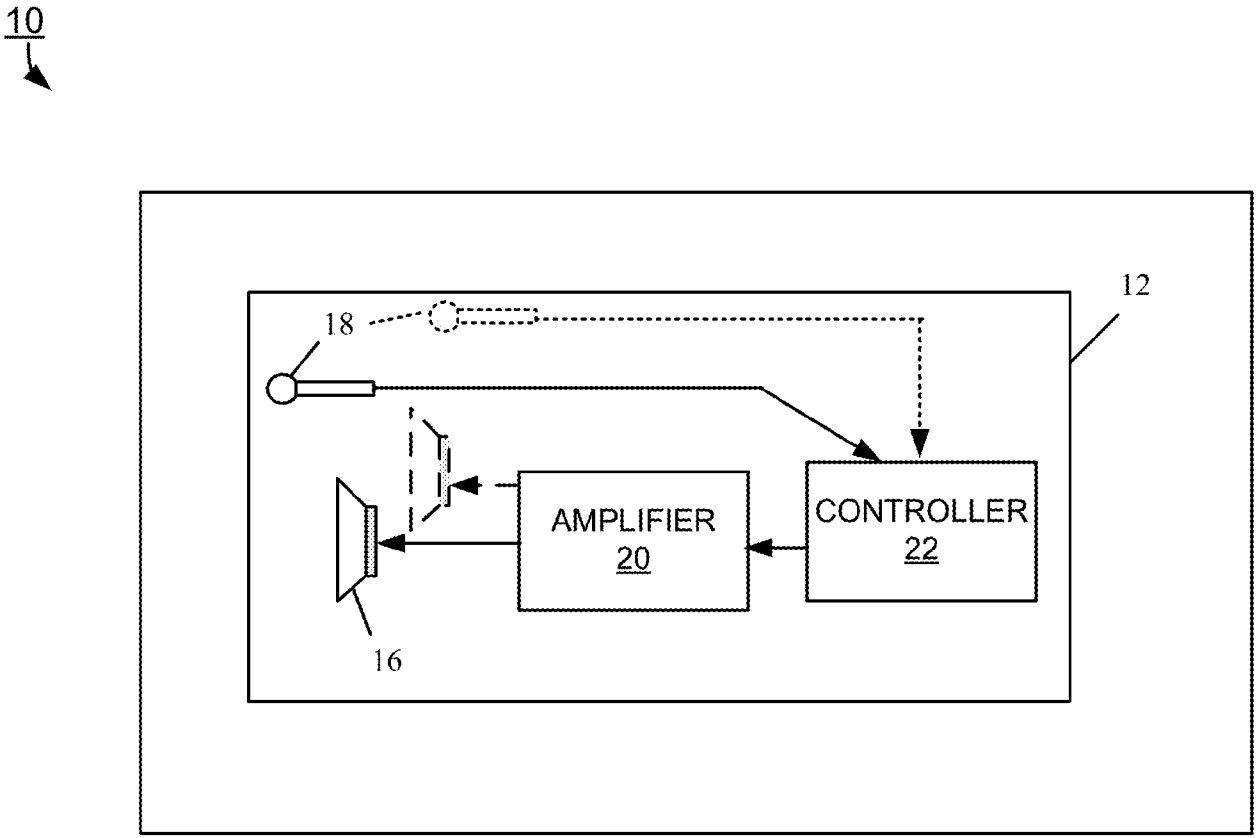
FIG. 1 is a diagram of an environment having a noise-cancellation system installed therein.

FIG. 1 shows a generalized example of an environment 10 having a noise-cancellation system 12 installed therein for attenuating or canceling noise within the environment. The noise-cancellation techniques described herein can extend to a variety of specific environments, whether such environments are open or enclosed. For example, the deployment of the noise-cancellation system 12 can be in vehicles (e.g., automobiles, trucks, buses, trains, airplanes, boats, and vessels), living rooms, movie theatres, auditoriums; in general, anywhere the strategic placement of one or microphones can achieve noise cancellation for the occupants of such environments, as described below. In vehicles, for example, the noise-cancellation system 12 can serve to attenuate low-frequency road noise, advantageously reducing any need to add weight to certain regions of the vehicle for this purpose.

In the example shown, the noise-cancellation system 12 includes one or more speakers 16, one or more microphones 18, an amplifier 20, and a controller 22. The controller 22 may be embodied in the amplifier 20. The strategic placement of the one or more microphones 18, as described herein, achieves noise reduction or cancellation at an ear of an occupant within the environment 10. Specifically, for a noise-cancellation system 12 with a single microphone, the microphone 18 is placed in the environment 10 where the acoustic transfer function for sound radiating from the one or more speakers 16 to the microphone 18 is substantially equal to the acoustic transfer function for the sound from the one or more speakers 16 to an ear of the occupant. In example with multiple speakers, the speakers 16 can be at positioned at different distances from the ear.

In general, an acoustic transfer function corresponds to a measured response between a source of sound (e.g., a loudspeaker) and the sound pressure at a given location. This measured response measures the relationship between the output (i.e., the sound detected at a given location) and the input (i.e., sound) coming from the sound source. The measured relationship is a function of frequency and has magnitude and phase components.

For a noise-cancellation system 12 with two or more microphones 18, the microphones 18 are combined to produce a composite response for sound emitted by the one or more speakers 16. The combination of microphones 18, in effect, operates as a single "virtual" microphone that produces this composite response. These multiple microphones 18 are strategically placed in the environment 10 at locations relative to the one or more speakers 16 such that their composite response has an acoustic transfer function that is substantially equal to the acoustic transfer function for the sound from the one or more speakers 16 to an ear of the occupant. Such strategic placement of these microphones 18 amounts to the strategic placement of a single "virtual" microphone where the acoustic transfer function for sound radiating from the speaker 16 to the virtual microphone is substantially equal to the acoustic transfer function for the sound from the one or more speakers 16 to an ear of the occupant. Hereafter, a reference made generally to a microphone broadly encompasses a single "real" microphone and a "virtual" microphone, unless the reference expressly mentions a "real" microphone or a "virtual" microphone.

An example of a technique for producing a virtual microphone that has a similar response to that of a real microphone at the occupant's ear is as follows. First, measurements are taken of the transfer function from the one or more speakers to the ear location, denoted $T_{de}(\omega)$, and the transfer functions from the one or more speakers to the microphones that will be combined to make the virtual microphone, denoted $T_{dsi}(\omega)$, where "i" denotes the i-th microphone used in the combination. An error metric (error) is defined as:

$$\text{error}=\|\Sigma_i H_i(\omega)T_{ds_i}(\omega)-T_{de}(\omega)\|^2 \quad \text{(Eq. 1)}$$

where $H_i(\omega)$ represents a filter applied to the i-th microphone. Then an optimization algorithm, for example, the Levenberg-Marquardt algorithm, can be used to minimize the error function by adjusting the parameters of the filters $H_i(\omega)$.

By placing a microphone where the acoustic characteristics of sound, namely, magnitude and phase, coming from one or more speakers substantially match the acoustic characteristics of that sound at the ear, the microphone is in position to detect precisely what the ear hears and to produce a signal representative of sound as heard by the occupant, though the microphone is distant from the ear. Accordingly, noise cancellation directed to sound detected by the microphone produces corresponding noise cancellation at the ear.

Figure 2:
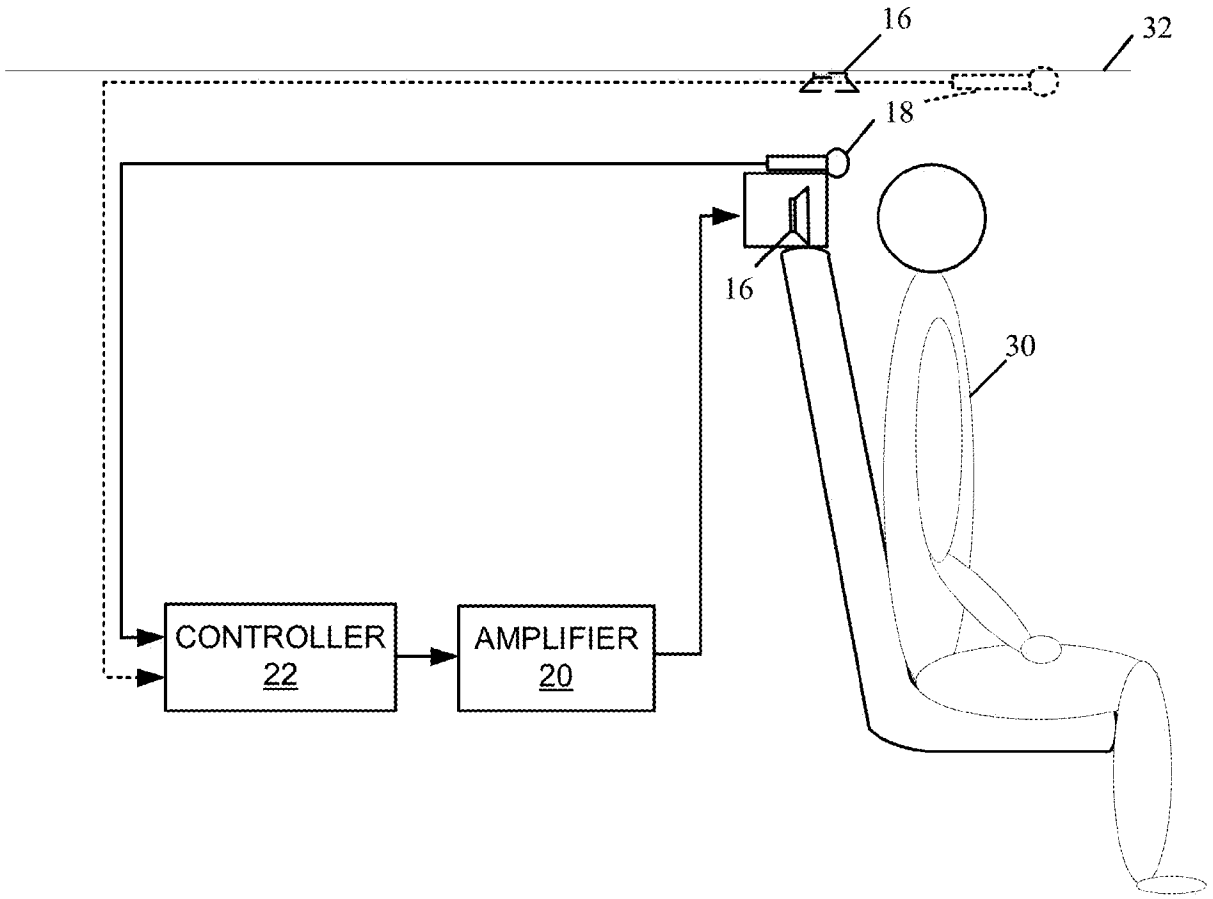
FIG. 2 is a diagram illustrating deployment of a noise-cancellation system within an environment relative to an occupant.

Generally, as illustrated in FIG. 2, the one or more speakers 16 may be disposed behind the occupant 30 within the environment, for example, mounted on a headrest, headliner, rear panel, or other interior surface of a vehicle. One real microphone 18 can be disposed, for example, on a driver 28 containing one of the one or more speakers 16; another real microphone 18 (shown in phantom) may be disposed in the headliner 32. The amplifier 20 and controller 22 may be disposed, for example, in the trunk of the vehicle or in the armrest of a recliner. The controller 22 is in electrical communication with the one or more real microphones 18 to receive the signal produced by each real microphone.

In response to the signals received from the one or more real microphones 18, the controller 22 executes an algorithm that generates an output signal. An objective of the algorithm is to achieve a noticeable reduction (e.g., at least 4 dB) in the noise in the signal. In general, the executed algorithm applies one or more filters to the signal produced by each real microphone 18. In the instance of multiple real microphones 18, the executed algorithm can apply a different filter to the signal produced by each real microphone 18, and combine the results to produce the output signal. An applied filter can be digital or analog, linear or non-linear.

The amplifier 20 receives and amplifies the output signal from the controller 22 and passes the amplified output signal to the one or more speakers 16. In response to the amplified output signal, the one or more speakers 16 produce a noise-reducing or cancelling sound with acoustic characteristics that are substantially inverse (i.e., approximately equal in magnitude and out-of-phase by 180 degrees) of the sound picked up by the microphone 18.

Figure 3:
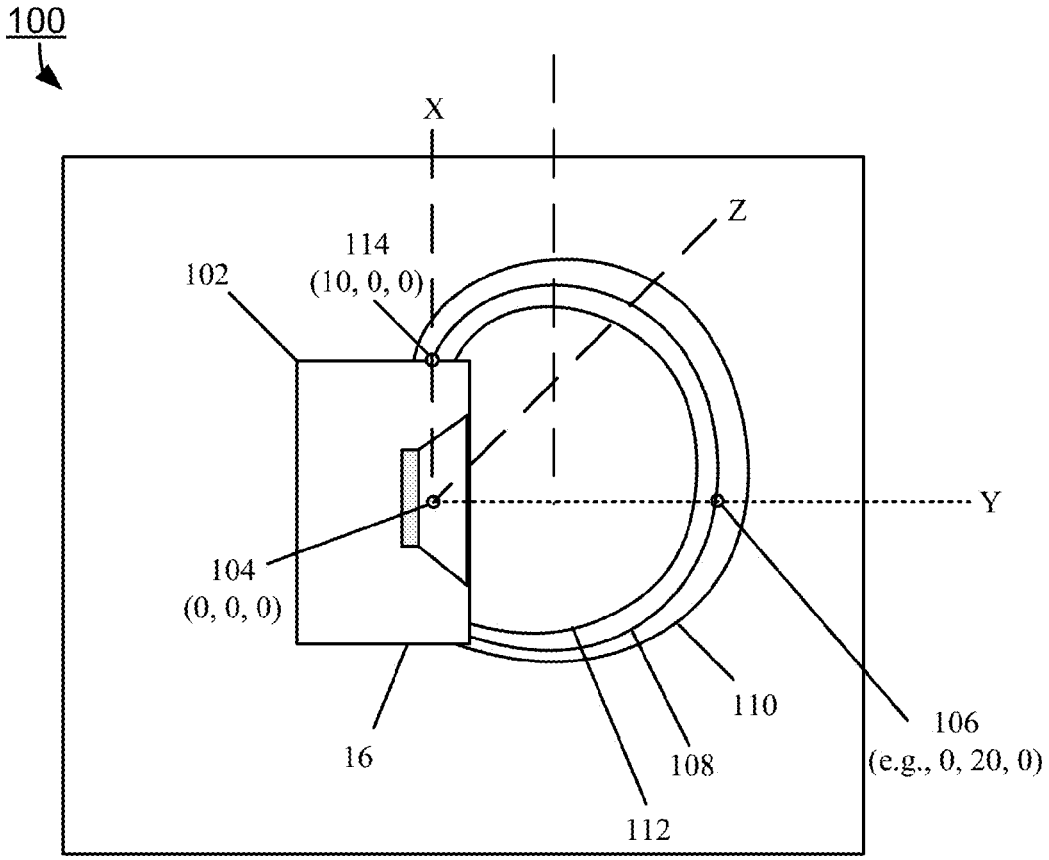
FIG. 3 is a model used to posit candidate locations for microphone placement for a given ear location relative to a speaker.

FIG. 3 shows a model 100 illustrating principles used to suggest locations where the transfer function is substantially similar to that of a nominal ear location for sound radiated by one of the one or more speakers 16 at a given frequency (e.g. 100 Hz). The model 100 includes a speaker driver (or box) 102 containing a speaker 16. The view in FIG. 3 corresponds to a vertical slice through the speaker driver 102 superimposed on a three-dimensional (3-D) coordinate system with X, Y, and Z-axes. The origin 104 (0, 0, 0) of the 3-D coordinate system is defined to be in front of the speaker 16. Sound radiates outwardly from this point and propagates towards a nominal ear location 106. In this example, the nominal ear location 106 is defined to be 20 cm distant from the coordinate system origin (0, 0, 0) on the y-axis at (0, 20, 0). The ear location 106 lies on a 3-D contour 108 produced by sound radiating from the speaker 16. The surface contour 108 represents a locus of points at which sound has substantially equivalent acoustic characteristics as the sound reaching the ear; that is, the acoustic transfer function from the speaker 16 to any given point on this contour 108 is substantially equal for every point on the contour 108. The contour 108 may be referred to as an iso-pressure surface. More specifically, the magnitude and phase of the sound from the speaker are substantially equal at all points on this contour 108.

Contour 110 represents another locus of points where the acoustic transfer function from the speaker 16 to any given point on the contour 110 is substantially the same for all points on the contour 110. For this contour 110, the acoustic transfer function has a smaller magnitude difference (e.g., −8.5 dB), a lagging phase difference (e.g., −35 degrees), or both, from the transfer function to the contour 108. The locus of points on spherical contour 112 represents another set of locations where the transfer function for sound from the speaker is substantially the same to all points on the contour 112. This transfer function has a greater magnitude difference (e.g., +4.5 dB), a leading phase difference (e.g., +35 degrees), or both, from the transfer function to points on the contour 108. Each of these contours 110, 112 represents another iso-pressure sphere nearer to and farther from, respectively, the speaker 16 than the iso-pressure sphere passing through the ear location 106.

Each contour 108, 110, and 112 intersects a top edge of the speaker box 102. In this example, the contour 108 intersects the top of the speaker box 102 at coordinate 114, that is, for example, 10 cm distant from the origin 104 along the X-axis or (10, 0, 0). Accordingly, the model 100 suggests that a microphone placed at coordinate 114, near the front edge of the speaker box 102, is expected to have a frequency response (i.e., in magnitude and phase) substantially equivalent to a frequency response experienced at the nominal ear location 106 at the modeled frequency. In other examples, the contour 108 may intersect a headrest or a headliner of a vehicle, suggesting other locations for placement of the microphone.

The contours 110, 112 of the model 100 may suggest boundaries for placement of a microphone to produce a substantially equivalent frequency response as a frequency response experienced at the nominal ear location 106. In the instance of a virtual microphone, any one or more of the real microphones 18 can be placed outside of the contours 110, 112, provided their combined response falls on or between the contours 110, 112.

Figure 4:
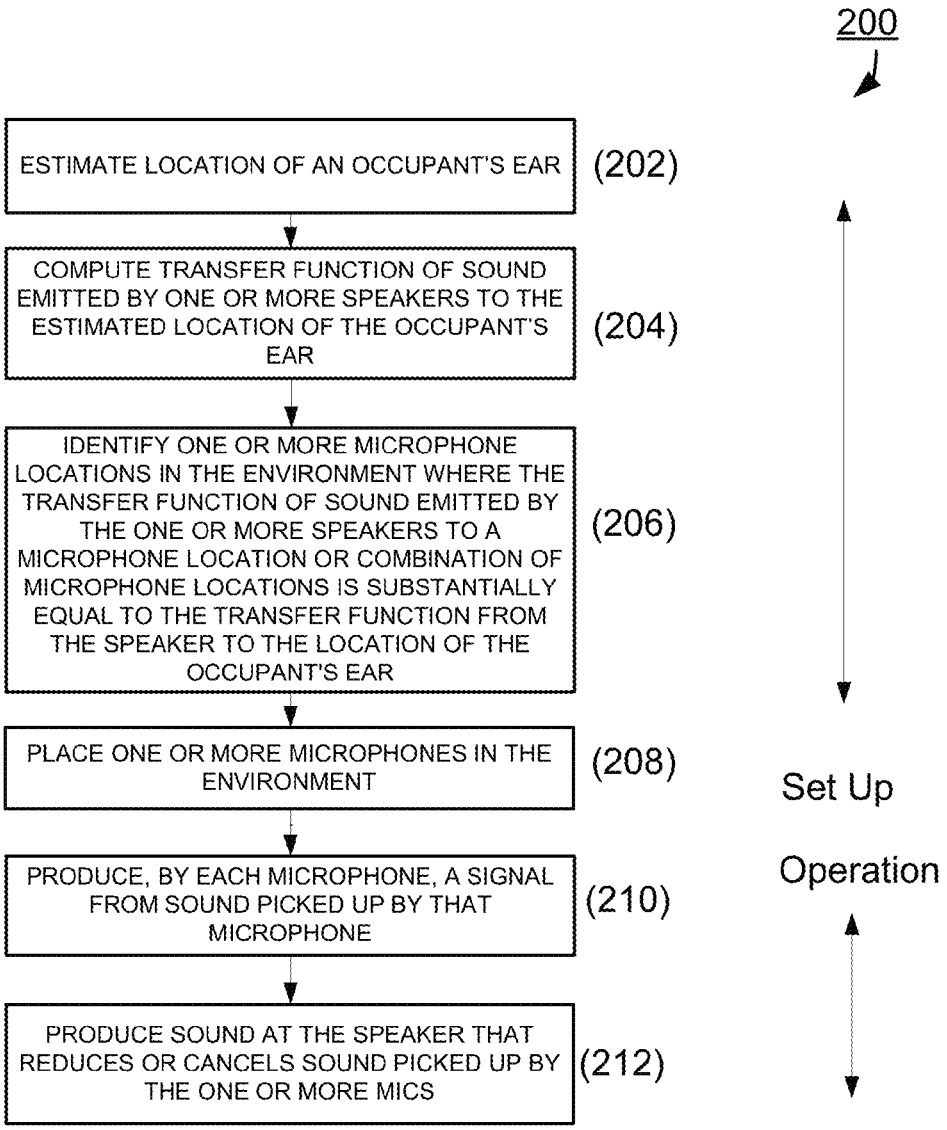
FIG. 4 is a flow diagram of a process for reducing noise heard by an occupant of a specific environment by the deliberate placement of one or more microphones at strategic locations within the environment.

FIG. 4 shows an example of a process 200 for performing noise cancellation near an ear location of an occupant with a specific, predetermined environment. In the description of the process 200, reference is made to the elements of FIG. 1. The process 200 includes a set-up stage during which the possible locations for microphone placement are identified and one or more microphones are placed in the area, and an operational stage during which the noise-cancellation system 12 performs noise cancellation. The set-up stage includes approximating (step 202) the ear location of a prospective occupant of the particular environment. The one or more speakers 16 emit a sound having a range of frequencies of interest (i.e., the original form of this audio signal is predetermined). For example, the design of the noise cancellation system 12 can be to attenuate low-frequency noises (5-150 Hz), and the audio signal contains frequencies that span a desired frequency range. A transfer function (i.e., its magnitude and phase response) is computed (step 204) from the one or more speakers to this estimated ear location for the range of frequencies in the emitted sound.

At step 206, one or more locations in the area are identified as a candidate location for microphone placement. Each candidate location corresponds to a place in the environment where the transfer function of the sound emitted by the one or more speakers is substantially equal to the transfer function computed for the nominal location of the occupant's ear. To identify each candidate location, the sound emitted from the one or more speakers 16 can be the same sound as that used to compute the transfer function at the approximate ear location. A microphone temporarily disposed at a candidate location picks up the sound from the one or more speakers 16, produces a signal, and sends the signal to the controller or other suitable electronic equipment. From this signal, the controller 22 or other suitable electronic equipment measures and compares the frequency response with the frequency response computed for the estimated ear location. Those measured frequency responses that satisfy certain criteria when compared to the frequency response computed for the ear location are considered matches (e.g., "equal to", "substantially equal to", "substantially similar as", "substantially equivalent to", "equivalent to", "similar enough to", or "the same as"), and are deemed acceptable candidate locations for microphone placement.

For example, one criterion for an acceptable match can be for the magnitude component of the frequency response for a candidate microphone location to be within +4.5 dB or −8.5 dB of the magnitude of the frequency response at the estimated ear location and the phase component of the frequency response for the potential microphone location to be within plus or minus 35 degrees of the phase of the frequency response at the estimated ear location. Another example of an acceptable match is for the transfer functions at a candidate microphone location and ear location to be similar enough to each other such that noise cancellation performed on sound picked up by the microphone at the candidate location achieves at least a 4 dB noise reduction measured at the ear location.

One example technique for identifying candidate locations is to perform a methodical 3-D mapping of the area near (although spatially separate, distant, or removed from) the ear location. This methodical mapping includes holding a microphone at a particular location within the area, detecting by the microphone a sound emitted from the speaker, computing the frequency response (i.e., transfer function) for the detected sound, comparing the frequency response for the particular microphone location with that of the ear location, and repeating (if desired) for another microphone location. Each measured frequency response may be linked to the particular physical location at which its measurement was taken by simultaneously tracking the location of the microphone during the measurement with cameras or a 3-D scanning device using structured-light or time-of-flight sensors (e.g., the Microsoft® KINECT™.)

A microphone (virtual or real) is placed (step 208) at one identified candidate location where the transfer function substantially matches the transfer function computed for the ear location. Placement of the (virtual or real) microphone at this location produces a "quiet zone" around the ear for the target range of frequencies.

During the operational stage, the microphone disposed at one candidate location detects sound, which may include frequencies deemed noise. In response to the sound, the microphone produces (step 210) a signal. In response to the signal from the microphone, the controller 22 produces (step 212) an output signal designed to cancel the noise in the sound received by the microphone when amplified by the amplifier 20 and converted to sound by the speaker 16.

Examples of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM.

Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A method of attenuating noise comprising:

identifying a location in an area at which sound emitted from one or more speakers has acoustic characteristics that are matched in measure to corresponding acoustic characteristics of the emitted sound at a location near an ear of an occupant of the area, the identifying comprising:

computing a first transfer function for the sound emitted from the one or more speakers at the location near the ear of an occupant of the area;

computing a second transfer function for the sound emitted from the one or more speakers at a second location in the area spatially separated from the location near the ear;

comparing the first transfer function to the second transfer function; and identifying the second location as a candidate for the identified location at which to place a microphone if the second transfer function is matched in measure to the first transfer function;

placing the microphone at the identified location; and generating, in response to sound detected by the microphone, a noise-canceling audio signal adapted to attenuate one or more frequencies in the sound detected by the microphone.

2. The method of claim 1, wherein the microphone is a virtual microphone comprised of multiple microphones placed in the area.

3. The method of claim 2, further comprising combining signals produced by the multiple microphones to produce a composite response with acoustic characteristics that are matched in measure to the acoustic characteristics of the emitted sound at the location near an ear of the occupant of the environment.

4. The method of claim 1, wherein the acoustic characteristics include phase and magnitude of the sound emitted from the one or more speakers.

5. The method of claim 1, further comprising determining the second transfer function is matched in measure to the first transfer function if a phase component of the second transfer function is within 35 degrees of a phase component of the first transfer function, and if a magnitude component of the second transfer function is within −8.5 dB or +4.5 dB of a magnitude component of the first transfer function.

6. The method of claim 1, wherein the area is a passenger compartment of a vehicle.

7. A vehicle comprising:

a passenger compartment;

a noise-cancellation system comprising:

one or more speakers disposed within the passenger compartment, the one or more speakers emitting sound; and a microphone disposed within the passenger compartment at a location where the sound emitted by the one or more speakers has a transfer function from the one or more speakers to the microphone that is matched in measure to a transfer function of the sound emitted from the one or more speakers to a location at an ear of an occupant of the passenger compartment, the microphone producing a signal in response to detecting sound; and a controller receiving the signal produced by the microphone and, in response to the signal, generating an output signal, wherein, in response to the output signal, the one or more speakers emit a noise-canceling audio signal adapted to attenuate one or more frequencies in the sound detected by the microphone.

8. The vehicle of claim 7, wherein the microphone is a virtual microphone comprised of multiple microphones placed within the environment.

9. The vehicle of claim 8, further comprising a controller receiving the signals produced by the multiple microphones, combining these signals to produce a composite signal with acoustic characteristics substantially equivalent to the acoustic characteristics of the emitted sound at the location near an ear of an occupant of the environment.

10. The vehicle of claim 7, wherein each transfer function has a magnitude component and a phase component.

11. The vehicle of claim 7, wherein the transfer functions are matched in measure to each other if a phase component of one of the transfer functions is within 35 degrees of a phase component of the other of the transfer functions, and if a magnitude component of one of the transfer functions is within −8.5 dB or +4.5 dB of a magnitude component of the other of the transfer functions.

12. The vehicle of claim 7, further comprising an amplifier receiving and amplifying the output signal produced by the controller and sending the amplified output signal to the one or more speakers for emission.

* * * * *